United States Patent [19]

Rae

[11] 3,999,158

[45] Dec. 21, 1976

[54] RANGE LIMITER FOR A THERMOSTAT

[76] Inventor: James T. Rae, 4810 Eastern Lane, Suitland, Md. 20023

[22] Filed: Feb. 5, 1975

[21] Appl. No.: 547,370

[52] U.S. Cl. ..... 337/360; 74/526; 337/323; 337/392

[51] Int. Cl.[2] ..... H01H 37/12

[58] Field of Search ..... 337/360, 84, 323, 392, 337/303; 236/94; 74/526; 200/333; 116/133

[56] References Cited

UNITED STATES PATENTS 3,121,151 2/1964 Mitick, Jr. ..... 337/323

*Primary Examiner*—Harold Broome
*Attorney, Agent, or Firm*—Christen & Sabol

[57] ABSTRACT

A thermostat having an ambient temperature responsive element, a switch mechanically coupled to the temperature responsive element for control thereby so as to cause reverse switch operations above and below a temperature setting, means for controlling the relationship between the switch and the temperature responsive element to establish a desired temperature. The temperature responsive element includes a manually operable thermostat setting member. The thermostat also contains support means including a removable cover. The manually operable thermostat setting member protrudes through the support or the cover. A range limiter is mounted in the thermostat so as to limit the movement of the manually operable thermostat setting member. The range limiter is readily removable after the cover is removed.

2 Claims, 18 Drawing Figures

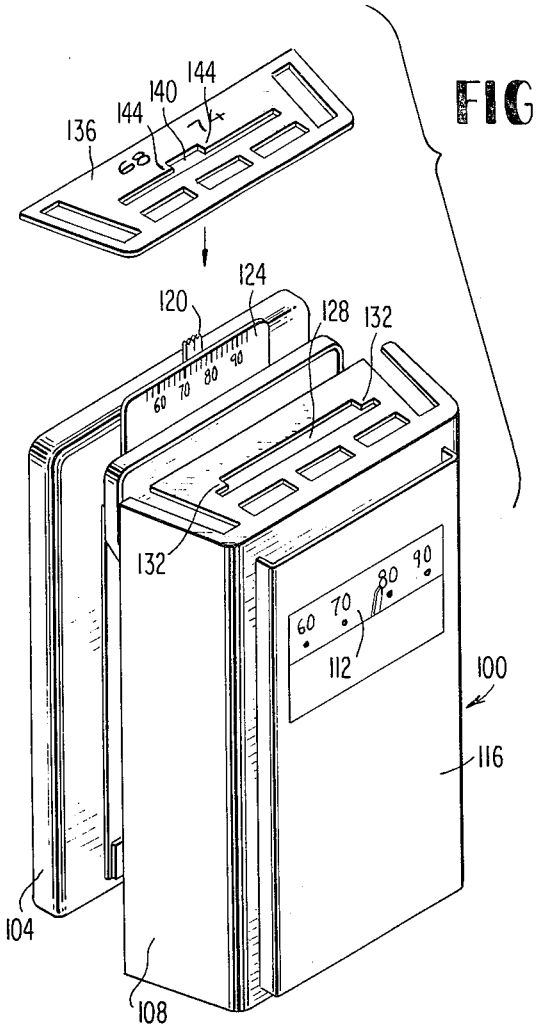
FIG. 1
FIG. 2
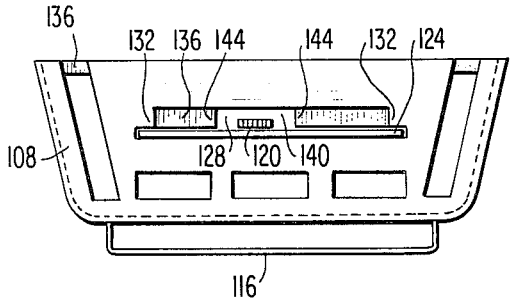
FIG. 3
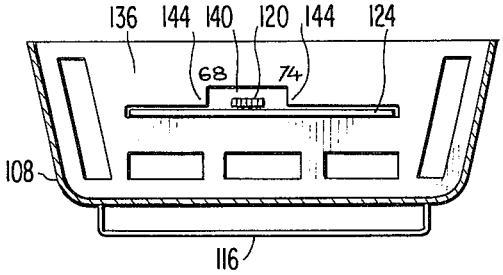
FIG. 4
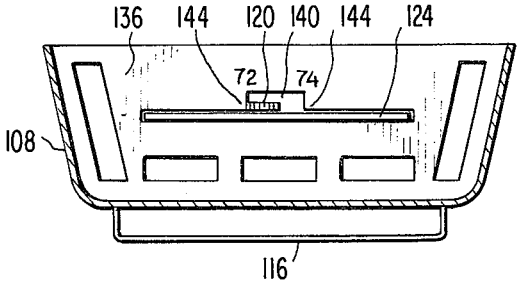
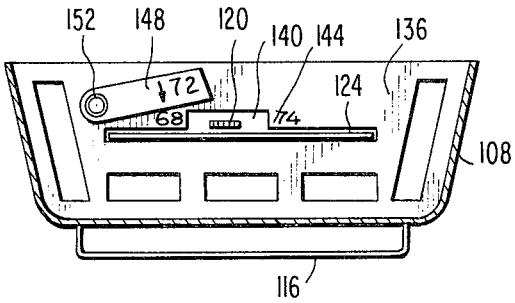
FIG. 5

FIG.6
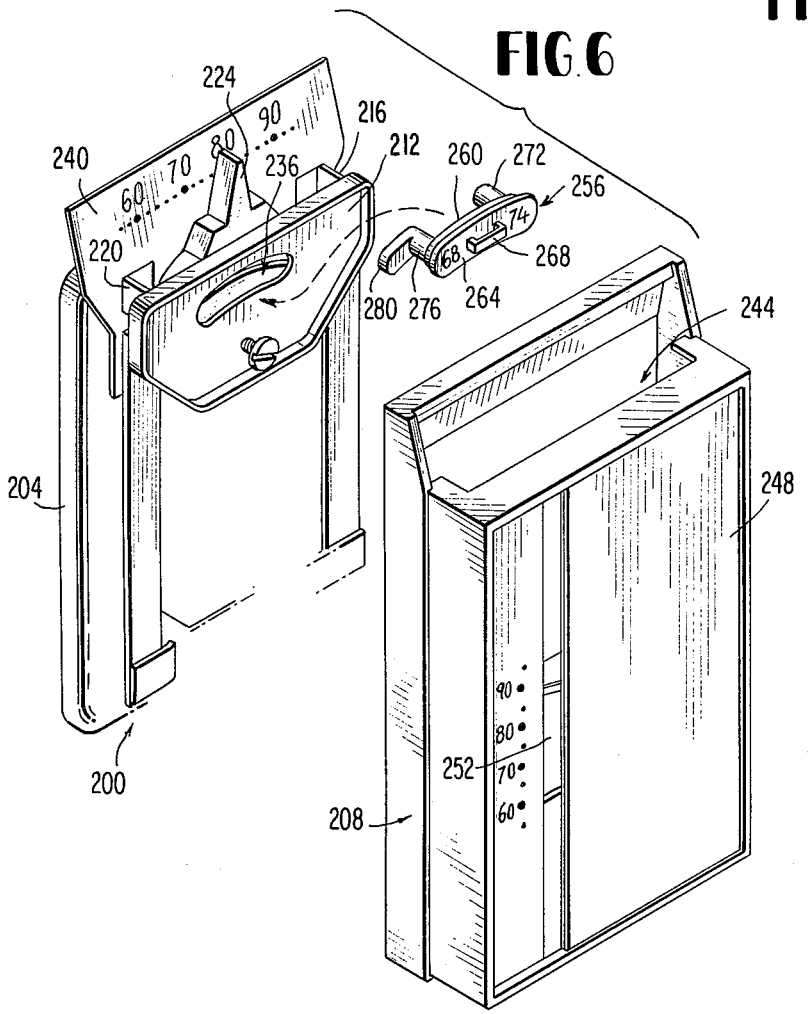
FIG.9
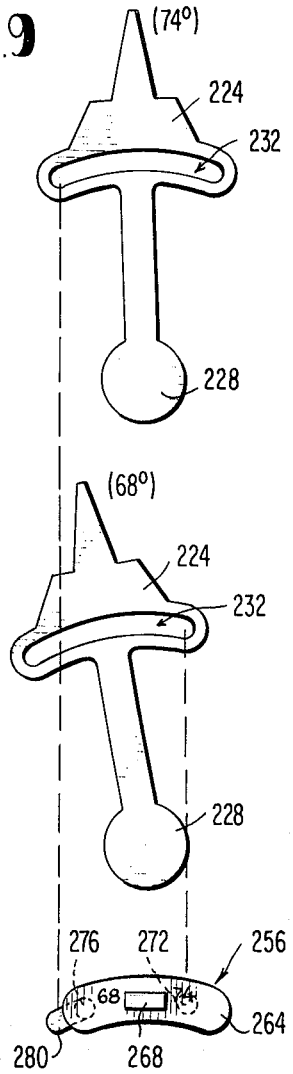
FIG.7
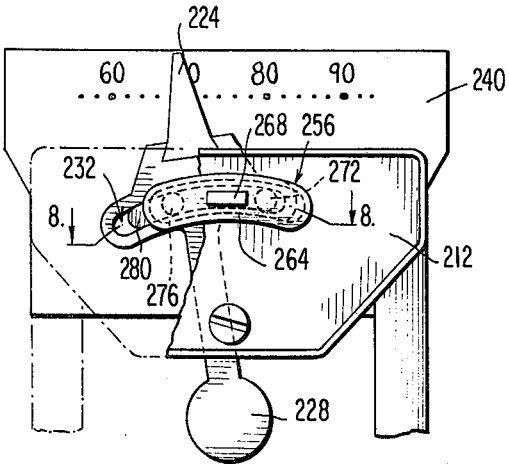
FIG.10
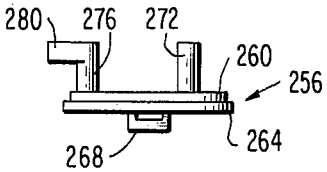
FIG.11
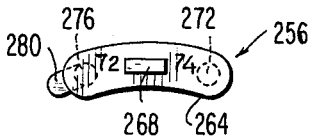
FIG.12
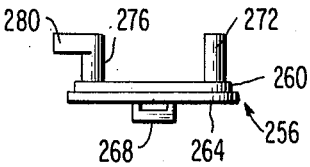
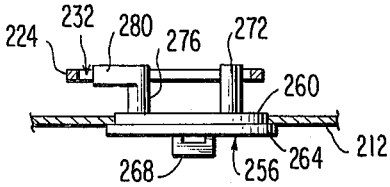
FIG.8

FIG. 13
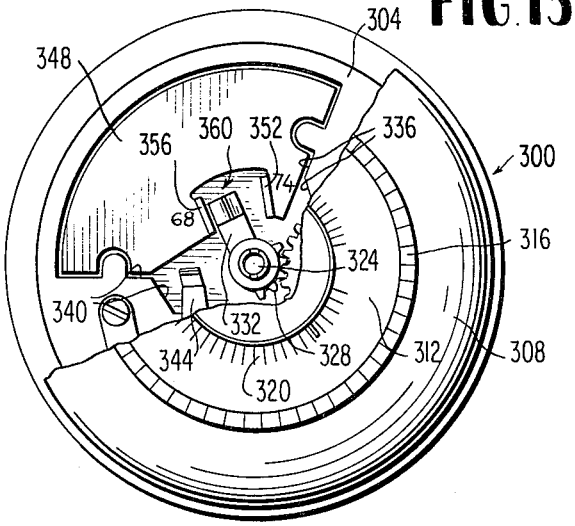
FIG. 14
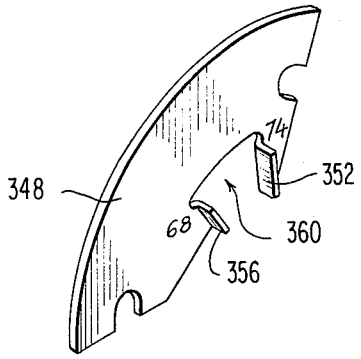
FIG. 15
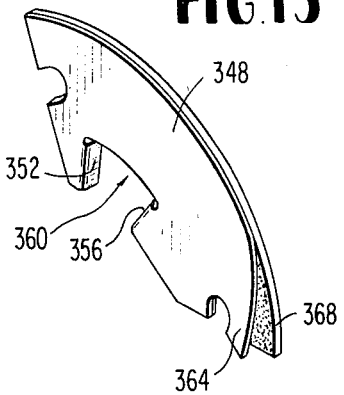
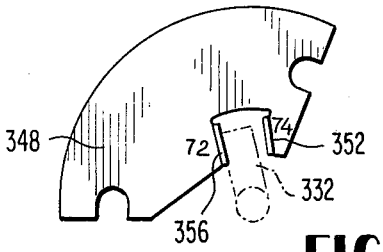
FIG. 16
FIG. 17
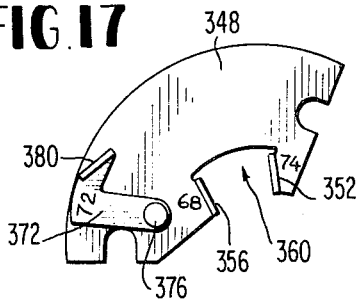
FIG. 18
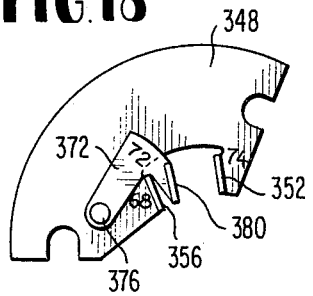

RANGE LIMITER FOR A THERMOSTAT

BACKGROUND OF THIS INVENTION

1. Field of This Invention

This invention relates to a range limiter for thermostats, especially thermostats for room-temperature control.

2. Prior Art

In the normal operation of a thermostat, the operating set-point is manually established by adjusting a control knob to a desired temperature. The heating apparatus of the room will deliver heat when the temperature drops below the set temperature and the heat will cut off when the temperature reaches or exceeds the set temperature of the thermostat. The occupant of the room adjusts the thermostat knob to establish different set-points. Poorly informed people are tempted to adjust the thermostat incorrectly. Thus, if the room temperature is below the desired temperature, an occupant may adjust the knob to a grossly excessive temperature setting, hoping that the room temperature will rise faster. The room temperature rises to the desired temperature and then the temperature rises well above the desired level. Then the occupant (if present) must adjust the thermostat to a lower setting. Once the room temperature is higher than desired, the temptation exists for the occupant to adjust the thermostat well below the desired temperature with the thought that such adjustment will cause the temperature to drop faster. Under such a too low thermostat setting, the heater does not turn on until the room temperature drops to the actual excessively low setting. Once again the occupant is unhappily exposed to an uncomfortable temperature.

In an effort to contend with this problem, thermostats often have range-limiting devices. Either a high-limit stop has been provided or a low-limit stop has been provided, and in some instances both high and low stops or range limiters have been provided. The arrangements are usually complicated and add significant cost. When a range limiter is provided, the adjustment is restricted to a modest latitude so that, even where an inexpert user is involved, the extent of misadjustment is limited. Accordingly, the consequences of improper adjustment are minimized. Range limiters are particularly valuable (for example) in motels, because it is not practical to indoctrinate each new guest into the proper use of his room thermostat. Such range limiters are divided into two classes. One class involves a range limiter mounted outside of the cover and/or support of the thermostat. This allows the occupant or guest to readily notice the range limiter and to manipulate or remove it, thereby defeating the purpose of the range limiter. Another class involves a range limiter mounted inside of the cover and/or support of the thermostat. This class of range limiters is permanently or semi-permanently mounted, so that they cannot be replaced with a limiter having a different range. This class also does not involve adjustable means for easily adjusting or changing the range. Further, this class of range limiters often involves a physical deforming or removal of part of the range limiter that makes range changing difficult or impossible using the same permanently (or semi-permanently) mounted range limiter.

Attention is drawn to U.S. Pat. Nos. 1,238,557, 1,348,841, 2,385,823, 2,562,425, 2,813,938, 3,011,039, 3,086,092, 3,670,284, 3,771,387 and 3,807,254.

BROAD DESCRIPTION OF THIS INVENTION

An object of this invention is to provide a range limiter for a thermostat which is readily changeable, but is not readily accessible to unauthorized persons. Another object is to provide such a range limiter which does not involve any physical modification thereof or of the thermostat, or any breaking off of some parts thereof or of the thermostat. A further object of this invention is to provide a process using the above range limiter. Other objects and advantages of this invention are set out herein or are obvious to one ordinarily skilled in the art herefrom.

The objects and advantages of this invention are accomplished by this invention.

This invention involves a thermostat having an ambient temperature responsive element, a switch mechanically coupled to the temperature responsive element for control thereby so as to cause reverse switch operations above and below a temperature setting, means for controlling the relationship between the switch and the temperature responsive element to establish a desired temperature. The temperature responsive element includes a manually operable thermostat setting member and the support means including a removable cover. The manually operable thermostat setting member protrudes through the support or the cover. A range limiter is mounted in the thermostat so as to limit the movement of the manually operable thermostat setting member. The range limiter is readily removable after said cover is taken off.

There is a need to limit the temperature range over which an occupant can vary the temperature in a rented, leased, etc., building, room, etc. This invention provides a ready means for setting desired upper and lower temperature limits, which can easily be changed by the owner and not by the occupant. This invention allows a savings of heat in the winter and a savings of cooling in the summer, without depriving the occupant of the option varying the room temperature within the normal (temperature) comfort zone.

In one preferred embodiment, the manually operable thermostat setting member is an elongated straight member, pivotally mounted on the end portion away from the end portion extending through the support or the cover — with the range limiter being a flat plate having an elongated non-curved slot therein. The ends of the non-curved slot limits the range of movement of the short arm.

In another preferred embodiment, the manually operable thermostat setting member is pivotally mounted and contains a short arm extending from the pivot, the short arm being located inside of said thermostat — with the range limiter being a flat plate having a curved slot therein with a raised stops at each end of the slot. The raised stops limits the range of movement of the short arm.

In a further preferred embodiment, the manually operable thermostat setting member is an elongated straight member, pivotally mounted on the end portion away from the end portion extending through the support or the cover and having a curved slot therein which lies on an arc having the pivot point as its center. A front plate, located in front of the setting member, is mounted on the support means and has a curved slot therein that is aligned with the curved slot in the setting member. The range limiter is a plate removably mounted in the curved slot in the front plate and has two extension portions which extend into the curved slot in the setting member. The extensions limit the range of movement of the setting member.

This invention also includes the range limiter mentioned above.

This invention further includes the process of using the range limiter of this invention in a thermostat.

This invention includes a control device which has a support that includes a removable cover, a selector member movably mounted in the control device and protruding through the support or the cover, and a range limiter for the selector member which is mounted in the control device and limits the extent of movement of the selector member. The range limiter is readily removable after the cover is removed.

As used herein, "readily removable" means, for example, a screw does not have to be unscrewed, etc., before the range limiter can be removed (not counting any screw, etc., holding the cover in place).

DETAILED DESCRIPTION OF THIS INVENTION

In the drawings:

FIG. 1 is a perspective view of a thermostat with a cover removed and shown in exploded position and with a removable range limiter (template) of this invention removed and shown in an exploded position;

FIG. 2 is a top view of the thermostat of FIG. 1, with a removable range limiter of this invention in place;

FIG. 3 is a horizontal cross section of the thermostat of FIG. 1 just above a removable range limiter of this invention;

FIG. 4 is a horizontal cross section of the thermostat of FIG. 1 just above another removable range limiter of this invention;

FIG. 5 is a horizontal cross section of the thermostat of FIG. 1 just above a further removable range limiter of this invention;

FIG. 6 is a perspective view of a thermostat with a cover removed and shown in exploded position and with a removable range limiter of this invention removed and shown in an exploded position;

FIG. 7 is a partial front view of the thermostat of FIG. 6 with a removable range limiter of this invention installed;

FIG. 8 is a cross section along line 8—8 in FIG. 7;

FIG. 9 is an exploded view of a manually operable thermostat setting member, in two positions, and a removable range limiter of this invention;

FIG. 10 is a top planar view of a removable range limiter of this invention shown in FIG. 9;

FIG. 11 is a top planar view of another removable range limiter of this invention;

FIG. 12 is a top planar view of a removable range limiter of this invention shown in FIG. 11;

FIG. 13 is a perspective view of a thermostat, partially cut away, showing a removable range limiter of this invention;

FIG. 14 is a perspective view of a removable limiter of this invention;

FIG. 15 is a perspective view, back side, of the removable limiter of FIG. 14;

FIG. 16 is a front planar view of another removable limiter of this invention;

FIG. 17 is a front planar view of a further removable limiter of this invention; and FIG. 18 is a further front planar view of the removable limiter of FIG. 17.

In FIG. 1, conventional thermostat 100 includes support plate 104 and cover 108, which removably snaps on support plate 104. Temperature indicator 112 is mounted on and in U-shaped front plate 116 of cover 108. The working mechanism of thermostat 100, such as, the ambient temperature responsive element, etc., is conventional and so is generally not shown. Manually operable thermostat setting member 120 is shown movably mounted behind temperature scale 124. Setting member 120 and temperature scale 124 protrude through elongated hole 128 in the top of cover 108. Extended lips 132 conventionally limit the movement of setting member 120 over a temperature range of about 56° to 94° F. Such a wide temperature range does not allow the avoidance of a temperature which is at an energy wasting high level (usually winter) or a low level (usually summer).

Temperature range limiter 136 is a flat template that fits immediately under the top of cover 108. Range limiter 136 contains elongated hole 140 — lips 144 thereof prevent the movement of setting member 120 beyond the desired (reduced) temperature range. FIG. 1 illustrates a desired temperature range of 68° to 74° F. — this illustrates a summer setting temperature range limiter.

Setting means 120 and temperature scale 124 protrudes through elongated slot 140. Generally, elongated slot 128 and elongated slot 140 are aligned with each other. FIG. 2 shows temperature range limiter 136 in place, and FIG. 3 is a further illustration thereof. (If desired, temperature range limiter 136 does not have to extend over the top lip of support plate 104. Temperature range limiter 136 should completely contact all appropriate walls in order to prevent it from slipping around.)

The desired winter temperature range can be achieved by inserting a modified temperature range limiter 136, as shown in FIG. 4, in place of the one shown in FIG. 3. The range limiter 136 of FIG. 4 has one lip 144 (or both) extended so that the desired temperature range is, for example, 72° to 74° F.

FIG. 5 illustrates a modified temperature range limiter 136 which takes the place of the two temperature range limiters of FIGS. 3 and 4. Arm 148 is pivotally mounted on range limiter 136 by means of pin 152. When swung out of the way so that arm 148 does not cover any of hole 140, the wider desired temperature range is obtained. When arm 148 is swung over to cover a portion of hole 140 so as to prevent movement of setting means 120 over to the covered lip 144, the narrower desired temperature range is obtained.

The use of the temperature range limiters, the preferred ones illustrated by the drawings of this invention, prevent the room etc., user from adjusting the thermostat so as to achieve a higher or lower temperature than the owner, etc., wants. This allows considerable energy cost savings by preventing excessive air conditioning or heating requirements.

In FIG. 6, conventional thermostat 200 includes support plate 204, cover 208, which removably fits on support plate 204 and front plate 212, which is mounted on support plate 204 by means of extension arms 216 and 220. The working mechanism of thermostat 200, such as, the ambient temperature responsive element, etc., is conventional and so is generally not shown. Manually operable thermostat setting member 224 is pivotally mounted at 228. Setting member 224 contains elongated curved slot 232 which generally aligns up with elongated curved slot 236 in front plate 212. Curved slot 236 lies on an arc which has its center at pivot point 228. Mounted behind setting member 224 is setting temperature indicator 240. Indicator 240 and the top of setting member 224 fit through hole 244 in the top of cover 208. Hole 244 is formed by U-shaped plate 248, that forms the front part of cover 208. Actual temperature indicator 252 is mounted on the front of plate 248. Setting member 224 has movement over a wide temperature range. Such a wide temperature range does not allow the avoidance of a temperature which is at an energy wasting high level (usually winter) or low level (usually summer).

Temperature range limiter 256 is an insert that snuggly fits into hole 236, not allowing any movement therein. Layer 260 of range limiter 256 corresponds in shape to hole 236. Layer 264 of hole range limiter 256 overlaps hole 236, assuring the positioning of range limiter 256. Range limiter 256 contains handle 268. Pins 272 and 276 are mounted on layer 260, and extend into hole 232 of range limiter 224. Pin 276 contains flat extension portion 280 on the bottom thereof. Pin 272 and pin 276 (extension 280) prevents the movement of setting means 224 beyond the desired (reduced) temperature range — see FIG. 8. FIG. 9 illustrates movement between a range of 68° and 74° F. — this illustrates a summer setting temperature range limiter.

The desired temperature range can be achieved by inserting a modified temperature range limiter 256, as shown in FIGS. 11 and 12 in place of the one shown in FIGS. 9 and 10. The range limiter 256 of FIGS. 11 and 12 has pin 272 set further away from pin 276 so that the desired temperature range is, for example, 72° to 74° F.

In FIG. 13, conventional thermostat 300 includes support plate 304 and cover 308, which removably snaps on support plate 304. The working mechanism of thermostat 300, such as the ambient temperature responsive element, etc., is conventional and is generally not shown. Manually operable thermostat setting member 312 is pivotally mounted in the center of cover 308 (see finger grip means 316). (Temperature indicator 320 is mounted in the lower center portion of thermosetting member 312.) Setting member 312 includes shaft 324, partial gear 328 and arm 332. Arm 332 normally serves as the range limiter of 300, being stopped on one side by edge 336 of support plate 304 and on the other side by edge 340 of support plate 308 (and off-contact switch 344). This allows a movement of setting member 312 over a temperature range of about 56° to about 94° F. Such a wide temperature range does not allow the avoidance of a temperature which is at an energy wasting high level (usually winter) or low level (usually summer).

Temperature range limiter 348 is a flat template, having two raised stops (352 and 356) that fit within the shown indent in support plate 304. Range limiter 348 contains elongated indent or open faced hole 360. The movement of arm 332 is prevented beyond a curtain (reduced) range by raised stops 352 and 356, which of course reflects a certain (reduced) temperature range. FIGS. 13 and 15 illustrate a desired temperature range of 68° to 74° F — this illustrates a summer setting temperature range limiter. (Temperature range limiter 348 should completely contact all appropriate walls of the indent in support plate 304 in order to prevent it from slipping around.)

The desired winter temperature range can be achieved by inserting a modified temperature range limiter 348, as shown in FIG. 16, in place of the one shown in FIG. 14. The range limiter 348 of FIG. 16 has raised stop 356 (or both) moved towards raised step 352 so that the desired temperature range is, for example, 72° to 74° F.

FIG. 15 illustrates range limiter 348 constructed from a laminated or layered material — see layers 364 and 368.

FIGS. 17 and 18 illustrate a modified temperature range limiter 348 which takes the place of two temperature range limiters of FIGS. 14 and 16. Arm 372 is pivotally mounted on range limiter 348 by means of pin 376. Arm 372 is L-shaped and contains raised stop 380 on the end away from pin 376. When swung out of the way so that arm 372 does not cover any of hole 360, the wider desired temperature range is obtained (see FIG. 17). When arm 372 is swung over to cover a portion of hole 360 so as to prevent movement of the setting means (arm 332) over to raised stop 352, the narrower desired temperature range is obtained (see FIG. 18).

The range limiters of this invention can be constructed of any convenient material, such as, plastics (preferred), metals, etc.

What is claimed is:

1. The thermostat having an ambient temperature responsive element, a switch mechanically coupled to said temperature responsive element for control thereby so as to cause reverse switch operations above and below a temperature setting, means for controlling the relationship between said switch and said temperature responsive element to establish a desired temperature, said temperature resonsive element including a manually operable thermostat setting member, support means including a removable cover, said manually operable thermostat setting member protruding through said support or said cover and being an elongated straight member, pivotally mounted on the end portion away from the end portion extending through said support or said cover and having a curved slot therein which lies on an arc having the pivot point as its center, wherein a front plate, located in front of said setting member, is mounted on said support means and has a curved slot therein that is aligned with said curved slot in said setting member, and said range limiter being a plate removably mounted, after said cover is removed, in said curved slot in said front plate and having two extension portions which extend into said curved slot in said setting member, the extensions limiting the range of movement of said setting member.

2. The thermostat having an ambient temperature responsive element, a switch mechanically coupled to said temperature responsive element for control thereby so as to cause reverse switch operations above and below a temperature setting, means for controlling the relationship between said switch and said temperature responsive element to establish a desired temperature, said temperature responsive element including a manually operable thermostat setting member, support means including a removable cover, and a range limiter, said range limiter being a flat plate having an elongated hole therein and being mounted in said thermostat so as to limit the movement of said manually operable thermostat setting member, said manually operable thermostat setting member being an elongated straight member pivotally mounted on one end, the opposite end of said manually operable thermostat setting member protruding through said support or said cover and through said elongated hole in said range limiter, the ends of said elongated hole limiting the range of movement of said thermostat setting member and said range limiter being readily removable after said cover is removed.

* * * * *